US010941517B2

(12) United States Patent
Ong et al.

(10) Patent No.: US 10,941,517 B2
(45) Date of Patent: Mar. 9, 2021

(54) HAND-HELD GARMENT STEAMER WITH SCALE COLLECTION CHAMBER

(71) Applicant: KONINKLIJKE PHILIPS N.V., Eindhoven (NL)

(72) Inventors: Chee Keong Ong, Eindhoven (NL); Zhifeng Xu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 320 days.

(21) Appl. No.: 16/060,598

(22) PCT Filed: Dec. 9, 2016

(86) PCT No.: PCT/EP2016/080352
§ 371 (c)(1),
(2) Date: Jun. 8, 2018

(87) PCT Pub. No.: WO2017/108440
PCT Pub. Date: Jun. 29, 2017

(65) Prior Publication Data

US 2018/0371684 A1 Dec. 27, 2018

(30) Foreign Application Priority Data

Dec. 24, 2015 (EP) ..... 15202698

(51) Int. Cl.
*D06F 75/10* (2006.01)
*D06F 75/12* (2006.01)
(Continued)

(52) U.S. Cl.
CPC ..... *D06F 75/10* (2013.01); *D06F 75/12* (2013.01); *A47L 11/34* (2013.01); *B08B 2230/01* (2013.01); *D06F 75/18* (2013.01); *D06F 87/00* (2013.01)

(58) Field of Classification Search
CPC ..... D06F 75/12; D06F 75/10; B08B 2230/01; A47L 11/4086; A47L 11/34
See application file for complete search history.

(56) References Cited

U.S. PATENT DOCUMENTS 3,805,425 A 4/1974 Spoida
5,345,704 A 9/1994 Guillot
(Continued)

FOREIGN PATENT DOCUMENTS

CN 1047638 C 3/1994
EP 0347196 A1 12/1989
(Continued)

*Primary Examiner* — Joseph L. Perrin
*Assistant Examiner* — Kevin G Lee

(57) ABSTRACT

The present application relates to a hand-held garment steamer (1) comprising a steam generating chamber (5) having a surface (9) and a heater (10) to heat the surface (9) such that water fed onto the surface (9) is converted into steam. The hand-held garment steamer (1) further comprises a scale collection chamber (14) having an opening (25). The surface (9) and opening (25) are positioned relative to each other and configured so that when the garment steamer (1) is in a first orientation (A) in which the surface (9) extends downwardly away from the opening (25), water fed onto the surface (9) flows away from the opening (25) to be evaporated from the surface (9). When the garment steamer (1) is in a second orientation (B) in which the surface (9) extends downwardly towards the opening (25), scale dislodged from the surface (9) falls into the scale collection chamber (14) through the opening (25). The scale collection chamber (14) is located below the steam generating chamber (5) in both the first orientation (A) and the second orientation (B). The present application also relates to a garment steaming system (40) comprising the hand-held garment steamer (1).

19 Claims, 10 Drawing Sheets

(51) Int. Cl.

| | |
|---|---|
| *D06F 75/18* | (2006.01) |
| *A47L 11/34* | (2006.01) |
| *D06F 87/00* | (2006.01) |

(56) References Cited

U.S. PATENT DOCUMENTS

| | | | | |
|---|---|---|---|---|
| 5,609,047 | A * | 3/1997 | Hellman, Jr. | D06F 73/00 239/538 |
| 6,237,341 | B1 | 5/2001 | Koike | |
| 2006/0266391 | A1* | 11/2006 | Wang | B01D 45/06 134/105 |
| 2013/0125940 | A1 | 5/2013 | Morgan | |
| 2015/0068170 | A1* | 3/2015 | Collet | D06F 75/20 55/385.1 |

FOREIGN PATENT DOCUMENTS

| | | | | |
|---|---|---|---|---|
| EP | 2584089 | A1 | 4/2013 | |
| EP | 2789729 | B1 | 4/2015 | |
| JP | 55170099 | U * | 12/1980 | |
| WO | 2015010969 | A1 | 1/2015 | |
| WO | WO-2015010968 | A1 * | 1/2015 | F22B 1/287 |
| WO | 2015101548 | A1 | 7/2015 | |

* cited by examiner

HAND-HELD GARMENT STEAMER WITH SCALE COLLECTION CHAMBER

This application is the U.S. National Phase application under 35 U.S.C. § 371 of International Application No. PCT/EP2016/080352, filed on Dec. 9, 2016, which claims the benefit of International Application No. 15202698.5 filed on Dec. 24, 2015. These applications are hereby incorporated by reference herein.

FIELD OF THE INVENTION

The present invention relates to a hand-held garment steamer. The present invention also relates to a garment steaming system comprising the hand-held garment steamer.

BACKGROUND OF THE INVENTION

Garment steaming systems are used to remove creases from garments and fabric, such as clothing and bedding. Generally garment steaming systems comprise a main body, or base unit, having a water reservoir and a steam generating chamber, a hand-held garment steamer, and a hose which connects the base unit to the hand-held garment steamer.

Water is fed from the water reservoir in the base unit into the steam generating chamber in which it is converted into steam. Steam is then transported to the hand-held garment steamer through the hose and exits onto the fabric in an attempt to obtain effective removal of creases. However, the steam generated in the base unit often condenses to form water on its journey from the steam generating chamber. This may cause condensed water to be dripped onto the garment.

To reduce the length of the steam pathway from the steam generating chamber to the garment, it is known to place the steam generating chamber in the hand-held garment steamer. However, such a steam generating chamber must be smaller than one located in the base unit and in countries where tap water is hard, the operating life of such a steam generating chamber is short due to the steam generating chamber becoming filled with scale. It is also known that the water reservoir may also be placed in the hand-held garment steamer.

The scale build up on the steam generating surface insulates a heating element from water in steam generating chamber which prevents evaporation. The insulation of the heating element may cause it to overheat and break. Furthermore, scale may exit the steam generating chamber with the steam as the hand-held garment steamer is moved from the beginning of a steaming stroke toward the end of the steaming stroke.

The published U.S. Pat. No. 5,345,704A describes an electric steam iron comprising a casing whose rear provides a heel and a sole heated by an electric resistance, and is adapted to occupy two positions, either an ironing position in which it rests on the sole, or a rest position in which it rests on the heel. The sole has a partition forming with a closure plate a vaporization chamber which is supplied with water from a reservoir and which, on the one hand, communicates with a steam distribution chamber having outwardly opening steam distribution openings, and, on the other hand, comprises a so-called de-scaling opening into a rear portion of the iron and closed by a removably mounted closure. The closure is a removable receptacle for recovery of calcified deposit communicating by a weir with a vaporization chamber, so that the calcified deposit present in the vaporization chamber falls into the receptacle particularly when the iron occupies its rest position.

SUMMARY OF THE INVENTION

It is an object of the invention to provide a hand-held garment steamer which substantially alleviates or overcomes one or more of the problems mentioned above.

The invention is defined by the independent claims. The dependent claims define advantageous embodiments.

According to the present invention, there is provided a hand-held garment steamer comprising a steam generating chamber including a surface, a heater to heat the surface such that water fed onto the surface is converted into steam, and a scale collection chamber having an opening, the surface and the opening being positioned relative to each other and configured so that when the garment steamer is in a first orientation in which the surface extends downwardly away from the opening, water fed onto the surface flows away from the opening to be evaporated from the surface, and when the garment steamer is in a second orientation in which the surface extends downwardly towards the opening, scale dislodged from the surface falls into the scale collection chamber through the opening. The scale collection chamber is located below the steam generating chamber in both the first orientation and the second orientation.

With this solution, all or most of the water fed onto the surface can be evaporated in the first orientation. In case not all the water fed on the surface in the first orientation has been evaporated, the remaining non-evaporated water can be evaporated when the hand-held garment steamer takes the second orientation. Thus, this solution allows an efficient conversion of water into steam. Also, this solution allows collecting scale dislodged from the surface. When the hand-held garment steamer is moved into the second orientation, substantially only or mainly scale may enter the scale collection chamber. This contributes to extending lifetime of the steam generating chamber.

In one embodiment, the opening is on the surface. In another embodiment, the opening is on a side wall of the steam generation chamber. Preferably, the hand-held garment steamer further comprises a treatment surface for treating a garment. The treatment surface is at any angle between about 45 degrees to (about) 165 degrees from the surface, preferably from about 90 degrees to about 130 degrees.

Optionally, the treatment surface may further comprise one or more steam vents for the ejection of steam towards a garment.

Therefore, the steam generated in the steam generating chamber can be used to effectively remove wrinkles from a garment.

Preferably, the appliance may comprise a steam channel coupling or connecting the steam generating chamber and the steam vent.

The steam channel may comprise an aperture for the passage of steam out of the steam generating chamber, the aperture being spaced above the opening to the scale collection chamber in the first and second orientations.

By having the aperture above the opening, the likelihood of water and scale travelling down the surface and out of the steam generating chamber through the steam channel is reduced.

Optionally, the steam channel may protrude into the steam generating chamber over the opening to the scale collection chamber, the channel terminating in an end face in which the aperture is provided.

By extending the steam channel into the steam generating chamber over the opening, the likelihood of scale exiting the scale collection chamber and travelling into the aperture when the hand-held garment steamer is tilted is significantly reduced.

Preferably, the steam channel may be configured to separate water droplets from steam.

For instance, at least a portion of the steam channel may be tortuous. The tortuous path helps to trap water droplets carried by the steam.

Optionally, the walls forming the steam channel may be heated by the heater for heating the surface. There may be an intermediate section coupling the heater and the walls of the steam channel, the intermediate section being configured to transmit heat from the heater to the walls of the steam channel.

Alternatively, the appliance may comprise a separate heater for heating the wall of the steam channel. This reduces the likelihood of water condensing along the steam channel. Furthermore, heating the steam channel evaporates the water that has condensed. This also helps to ensure to reduce the water droplets present in the steam that is emitted from the steam vent.

The protrusion of the steam channel and the heated tortuous steam channel may allow the hand-held steamer suitable for use in horizontal steaming. The protrusion of the steam channel into the steam chamber reduces the likelihood of liquid water from escaping from the steam generating chamber to the steam vent. The heating of tortuous steam vent helps to evaporate any water that has got into the steam channel.

Optionally, the hand-held garment steamer may be configured so that it moves from the first to the second orientation when tilted through an angle of up to 90 degrees.

Therefore, the hand-held garment steamer can be used and will function effectively within a comfortable range of motion for a user.

Preferably, the scale collection chamber is located at one end of the surface. An "end" as described herein may refer, for example, to an end portion within 10 mm from the side wall.

Therefore, scale only enters the scale collection chamber when the hand-held garment steamer is in the second orientation. This means a user can bring the appliance to the second orientation to ensure all scale falls into the scale collection chamber. By having the scale collection chamber located at one end of the surface, the distance that water fed onto the surface travels during the first orientation or second orientation can be maximized before reaching the opening of the scale collection chamber.

Preferably, the scale collection chamber is configured to trap scale collected in the scale collection chamber to prevent it from escaping from the scale collection chamber as the garment steamer is tilted between the first orientations and the second orientation.

Therefore, once it has been collected, scale cannot escape the steam generation chamber to be ejected onto a garment. This helps to prevent scale staining garments when they are being treated.

Optionally, the scale collection chamber may have a wall that forms an angle of less than 90 degrees relative to the surface. In other words, the wall extends or diverges away from an opposing wall with increasing depth.

The scale collection chamber having the wall angled less than 90 degrees relative to the surface increases the volume of the scale collection chamber. Furthermore, the overhanging wall that is less than 90 degrees relative to the horizontal helps to prevent scale, or water, travelling along said wall. Therefore, the scale collection chamber can hold more scale, and/or water, or be tilted through a greater range of angles before it is full enough for some to escape out of the scale collection chamber.

Optionally, the scale collection chamber may comprise a barrier element to prevent scale collected in the scale collection chamber from escaping the scale collection chamber.

The barrier element provides a physical barrier to stop scale, or water, exiting the scale collection chamber. It also increases the volume of scale, and/or water, that can be stored in the scale collection chamber before it is full enough for some to escape from the scale collection chamber.

Optionally, the scale collection chamber may be removable.

Therefore, once the scale collection chamber is full it can be removed, emptied, and reinstalled. This prolongs the life-time of the hand-held garment steamer. Furthermore, a scale collection chamber can be replaced instead of buying a whole new hand-held garment steamer which saves the consumer money.

Preferably, the surface may be planar or may be patterned.

The planar surface encourages the water to form a thin film which increases the likelihood that the water will evaporate. Furthermore, only a thin layer of scale will form which can be cracked by thermal shock when more water is fed onto the surface. The planar surface is also difficult for scale to stick to.

Preferably, the hand-held garment steamer may comprise a water inlet to feed water onto the surface.

The water inlet may be so located that the length of the water path is maximized as water can flow the full length of the surface away from the scale collection chamber when in the first orientation and then back down the full length of the surface towards the scale collection chamber when tilted to the second orientation. This increases the likelihood of the water evaporating and only scale entering the scale collection chamber.

The hand-held garment steamer preferably comprises a water reservoir. The water reservoir may be detachable. The hand-held garment steamer comprises a pump to direct water from the water reservoir to the water inlet.

According to another aspect of the present invention, there is provided a garment steaming system comprising the hand-held garment steamer according to the invention, a stand on which to hang a garment to be steamed, and a water reservoir for supplying water to the hand-held garment steamer for conversion into steam.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
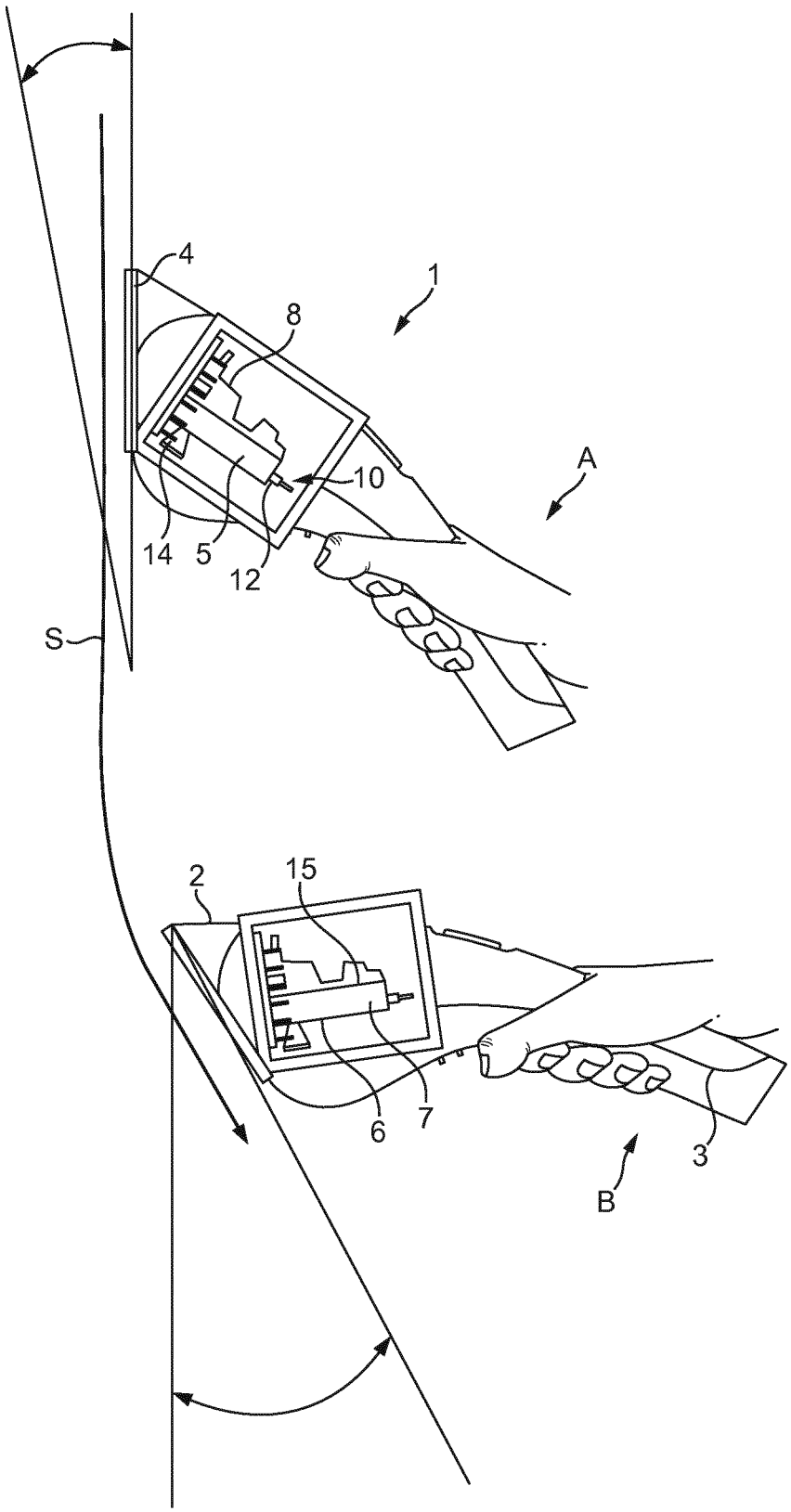
FIG. 1 shows a side view of a first and second orientation of a hand-held garment steamer according to the present invention with a section of a housing portion removed to show a steam generating chamber and a scale collection chamber.

Referring to the drawings, there is provided a hand-held garment steamer 1 comprising a steam generating chamber 5 including a surface 9, a heater 10 to heat the surface 9 such that water fed onto the surface 9 is converted into steam, and a scale collection chamber 14 having an opening 25, the surface and the opening 25 being positioned relative to each other and configured so that when the garment steamer 1 is held in a first orientation A in which the surface 9 extends downwardly away from the opening 25, water fed onto the surface 9 flows away from the opening 25 to be evaporated from the surface, and when the garment steamer 1 is tilted into a second orientation B in which the surface extends downwardly towards the opening 25, scale dislodged from the surface 9 falls into the scale collection chamber 14 through the opening 25. The scale collection chamber 14 is located below the steam generating chamber 5 in both the first orientation A and the second orientation B.

Referring to FIG. 1, the hand-held garment steamer 1 is shown at the beginning of a steaming stroke, indicated by arrow S. The hand-held garment steamer 1 begins the steaming stroke S at the top of the stroke where it is in its first orientation, indicated by arrow A. The hand-held garment steamer 1 is moved along the steaming stroke S towards the second orientation, indicated by arrow B, proximate to the end of the steaming stroke S. During its transition from the first orientation A at the top of the steaming stroke S to its second orientation B at the bottom of the steaming stroke S the hand-held garment steamer 1 is rotated so that the user is comfortable for the duration of the stroke S.

Optionally, the hand-held garment steamer 1 may comprise a housing 2 having a handle portion 3. The handle portion 3 is configured so that a user may easily grip the hand-held garment steamer 1 during use. The handle portion 3 may be constructed ergonomically. Preferably, at the opposite end of the housing 2 to the handle portion 3 is a treatment surface 4 which is configured to be placed proximate to or on a fabric to be treated. As shown in FIG. 1, the treatment surface 4 is positioned such that it is substantially vertical in the first orientation A and is rotated through an angle of up to 90 degrees to reach the second orientation B, in which the treatment surface 4 is positioned at an angle to the vertical.

In FIG. 1, a portion of the housing 2 has been removed to show a side view of the arrangement of the components located inside the housing 2 of the hand-held garment steamer 1 in both the first A and second B orientations. The hand-held garment steamer 1 comprises the steam generating chamber 5.

The steam generating chamber 5 extends at an angle to the treatment surface 4 such that it is rotated through the horizontal when the hand-held garment steamer 1 is moved along the steam stroke S from the first orientation A to the second orientation B.

In one embodiment the steam generating chamber 5 comprises a bottom wall 6, a side wall 7, and a top wall 8. The side wall 7 extends perpendicularly from and extends around the bottom wall 6. The top wall 8 forms a lid which closes off the steam generating chamber 5, as will be described in more detail hereinafter.

Figure 2:
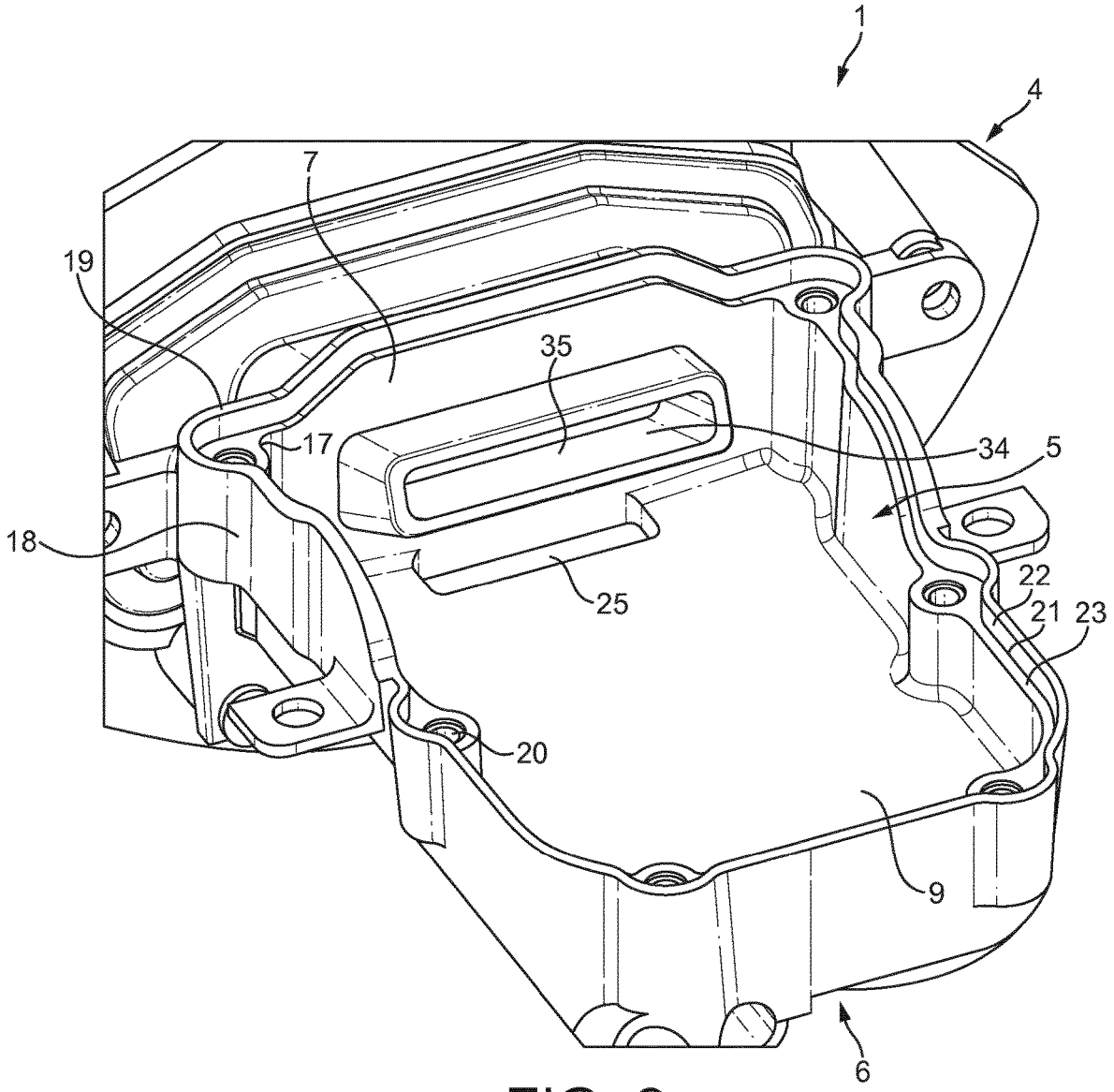
FIG. 2 shows a perspective view of the steam generating chamber of FIG. 1 with its lid removed.

The steam generating chamber 5 further comprises the surface 9, shown in FIG. 2. The surface 9 is the top surface of the bottom wall 6 and faces into the steam generating chamber 5. The surface 9 is configured to receive water that is fed into the steam generating chamber 5.

Optionally, the hand-held garment steamer 1 further comprises the heater 10. The heater 10 comprises a heating element 11, shown in FIG. 3, and terminals 12 which connect the power supply (not shown) to the heating element 11. The heating element 11 is embedded in the bottom wall 6 of the steam generating chamber 5. The heater 10 is configured to heat the surface 9, shown in FIG. 2 and FIG. 3, of steam generating chamber 5 so that water fed onto the surface 9 of the steam generating chamber 5 is evaporated to steam. The power supply may be, for example, but not limited to, mains supply or batteries.

As shown in FIG. 1, the hand-held garment steamer 1 further comprises the scale collection chamber 14 which is configured to collect scale that is left behind by the evaporated water. In the present embodiment, the scale collection chamber 14 is located below the steam generating chamber 5 and is located at one end of the surface 9 of the steam generating chamber 5. In FIG. 1, the scale collection chamber 14 is proximate to the treatment surface 4 end of the steam generating chamber 5. The scale collection chamber 14 has a longitudinal axis which extends perpendicularly to the longitudinal axis of the steam generating chamber 5. The scale collection chamber 14 is configured to trap scale collected in the scale collection chamber 14 to prevent it from escaping from the scale collection chamber 14 as the hand-held garment steamer 1 is tilted between its first orientation A and second orientation B, as will be described in further detail hereinafter.

In one embodiment, the bottom wall 6 may further comprise a temperature sensing device (not shown) to measure the temperature of the surface 9. The temperature sensing device may be disposed next to the surface 9 and connected to a control unit (not shown) to derive the corresponding temperature of the surface 9. The control unit may be further configured to control the temperature of the surface 9 by, for example, adjusting power delivered to the heating element 11, to ensure that the temperature of the surface 9 is at least above the evaporation temperature of water.

The heater 10 may be an on-off type heater, in which case the heater 10 is turned on when the temperature of the surface 9 falls below a predetermined value and is turned off when the temperature rises above a predetermined value. Alternatively, the heater 10 may have a variable power output such that a more constant temperature can be maintained on the surface 9. In this way, the temperature of the surface 9 can be accurately maintained at a sufficiently high temperature to evaporate all the water being fed onto the surface 9 before it reaches the scale collection chamber 14 so that none, or at least very little water, enters the scale collection chamber 14.

FIG. 1 also shows that the hand-held garment steamer 1 comprises a water inlet 15 located at the top of the steam generating chamber 5, as will be described in further hereinafter.

In FIG. 2, the hand-held garment steamer 1 is shown with the housing 2 and top wall 8 of the steam generating chamber 5, both shown in FIG. 1, removed so that the inside of the steam generating chamber 5 can be seen. The surface 9 of the steam generating chamber 5 is generally rectangular and planar. The rectangular surface 9 has its longer sides extending away from the treatment surface 4. The surface 9 is planar to encourage water fed onto the surface 9 to spread out to form a thin film and to prevent the build-up of scale that would occur on ribbed surfaces. In one embodiment, the planar surface 9 further comprises a non-stick finish to help prevent scale build-up on the surface 9. However, in an alternative embodiment, it will be understood by a person skilled in the art that the shape of the surface 9 may differ and may include elevated or sunken portions.

In the present embodiment, shown in FIG. 2, the side wall 7 of the steam generating chamber 5 extends perpendicularly from the bottom wall 6. In one embodiment, the side wall comprises an inner portion 17 and an outer portion 18 which extends further from the surface 9 than the inner portion 17 to form a border 19 around the inner portion 17. The inner portion 17 may comprise cylindrical portions that comprise holes 20 that are configured to receive screws (not shown) to secure the top wall 8, shown in FIG. 1 to the side wall 7. The shape of the top wall 8 corresponds to an edge 21 formed between a side face 22 of the border 19 and an upper face 23 of the inner portion 17. The border 19 and upper face 23 help to seal the steam generating chamber 5 to prevent steam escaping from the steam generating chamber 5 in an unwanted manner. In another embodiment, the top wall 8 may be secured to the side wall 7 via rivet mounting.

In one embodiment, the steam generating chamber 5 may further comprise a gasket (not shown). The gasket may be a thin sheet of silicon sealing material cut to a shape corresponding to the upper face 23 of the inner portion 17 of the side wall 7 and disposed between, and abutting, the top wall 8, shown in FIG. 1, and the upper face 23 when the top wall 8 is fixed onto the side wall 7. Advantageously, the gasket ensures that steam generated within the steam generating chamber 5 does not leak out. In an alternative embodiment, the bottom 6, side 7, and top 8 walls of the steam generating chamber 5, shown in FIG. 1, may be integrally formed.

Figure 7:
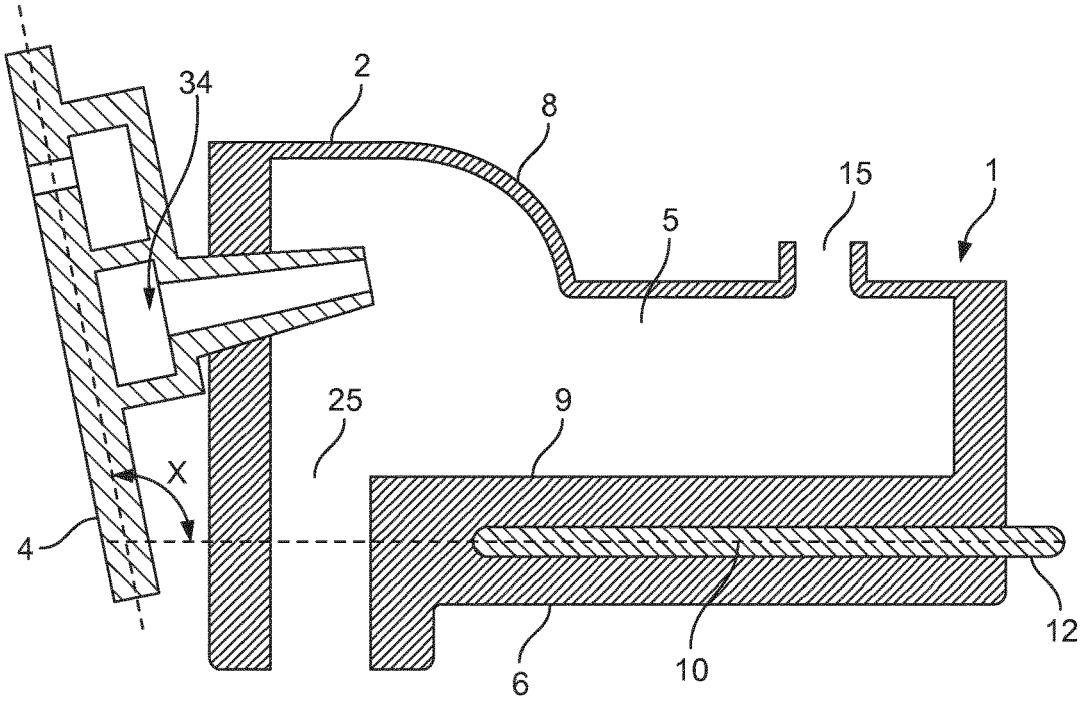
FIG. 7 shows a schematic cross-sectional side view of the embodiment of the steam generation chamber and scale collection chamber shown in FIG. 1 to FIG. 5.
Figure 8:
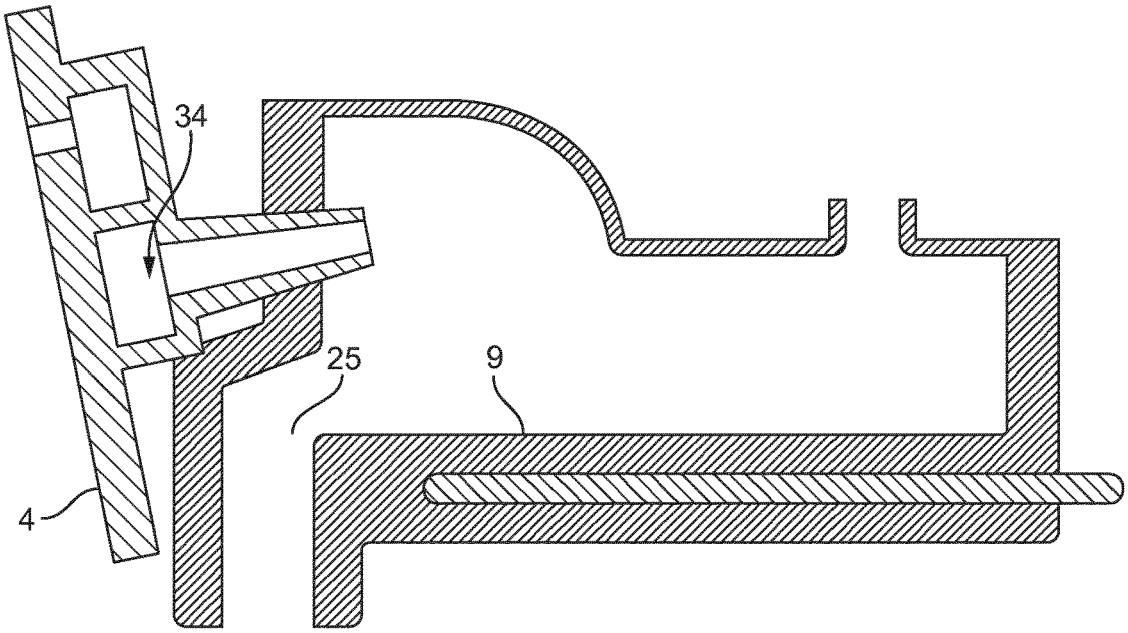
FIG. 8 shows a schematic cross-sectional side view of a second embodiment of the steam generation chamber and scale collection chamber.

The surface 9 comprises the opening 25 which is the entrance to the scale collection chamber 14, shown in FIG. 1 and FIG. 7, and is preferably located at the same end of the surface 9 as the scale collection chamber 14. That is, the opening 25 is at the top end of the surface 9 when the hand-held garment steamer 1 is in the first orientation A and at the bottom end of the surface 9 when the hand-held garment steamer 1 is in the second orientation B. The opening 25 is at least partially in the plane of the planar surface 9 such that there is no step between the surface 9 and the opening 25 to obstruct scale from passing off of the surface 9 and into the scale collection chamber 14. In the embodiments shown in the drawings, the openings 25 are substantially rectangular. However, in an alternative embodiment the opening 25 may be any other shape or positioned alternatively relative to the surface 9, such as on the side wall 7, as shown in FIG. 8.I In FIG. 8, the opening 25 may be on the portion of the side wall 7 that is proximate to the treatment surface 4. Referring briefly to FIG. 7, the angle X between treatment surface 4 and surface 9 is shown. The angle X may be between about 45 degrees to (about) 165 degrees, preferably from about 90 degrees to about 130 degrees. The treatment surface 4 may be configured to be movable with respect to the surface 9. For instance, the hand-held steaming device 1 may have an adjusting mechanism (not shown) to adjust the angle X between the treatment surface 4 and the surface 9. The adjusting mechanism may be, for example, but not limited to, a pivot connection.

The water inlet 15, shown in FIG. 1, is arranged in a hole (not shown) in the top wall 8 of the steam generating chamber 5 so as to dispense water onto the surface 9. Water may be fed onto the surface 9 in droplet form or as a spray. The water is spread out into a thin film by the surface tension of the water and the action of gravity. The film is evaporated to produce steam and causes scale to form on the surface 9. In one embodiment, the dispensing of water via water inlet 15 may be activated by an user. In another embodiment, the water inlet 15 may be connected to the controller (not shown) so that the flow rate of the water inlet 15 can be controlled in dependence on, for example, but not limited to, the temperature of the surface 9 or the orientation of surface 9 as indicated by, for example, an orientation sensor. In one embodiment, the water inlet 15 does not feed water onto the surface 9 when the hand-held garment steamer 1 is tilted past the horizontal from the first orientation A to the second orientation B to help prevent water entering the scale collection chamber 14. Conversely, as the surface 9 is tilted further from the horizontal into the first orientation A, more water may be fed onto the surface 9.

Water fed onto the surface 9 by the water inlet 15, shown in FIG. 1 will cause any scale on the surface 9 to break up by thermal shock. The temperature of the water will cool the scale which is heated by the surface 9. The heated surface 9 may be at least 30 degrees Celsius lower when it is wet (after being fed with water) compared to be when it is dry. Because the scale cools at a different rate to the surface 9, stresses and strains develop in the scale which causes it to break apart. It can then be transported to the opening 25 of the scale collection chamber 14.

Referring now to both FIG. 1 and FIG. 2, it can be seen that the surface 9 of the steam generating chamber 5 and the scale collection chamber 14 are positioned relative to each other so that when the hand-held garment steamer 1 is positioned in the first orientation A, the surface 9 extends downwardly away from the opening 25 to the scale collection chamber 14 such that water fed on the surface 9 through the water inlet 15 flows down the surface 9 in a direction away from the opening 25 to the scale collection chamber 14. The surface 9 and the opening 25 are also positioned relative to each other so that when the hand-held garment steamer 1 is positioned in the second orientation B, the surface 9 extends downwardly towards the opening 25 to the scale collection chamber 14 such that water fed on the surface 9 through the water inlet 15 flows down the surface 9 in a direction towards the opening to the scale collection chamber 14.

Therefore, during the steaming stroke S, water is fed onto the surface 9 when the hand-held garment steamer 1 is in the first orientation A and runs away from the opening 25 of the scale collection chamber 14 in the surface 9. When the steaming stroke S has been sufficiently completed such that the gradient of the surface 9 has switched so that the hand-held garment steamer 1 is in the second orientation B, water that has not been evaporated runs back towards the opening 25. This increases the length of the flow path of the water fed onto the surface 9 and helps to ensure that all the water is evaporated and does not enter the scale collection chamber 14. Furthermore, when the hand-held garment steamer 1 is in the second orientation B, scale falls down the surface 9 towards and through the opening 25 into the scale collection chamber 14.

Figure 3:
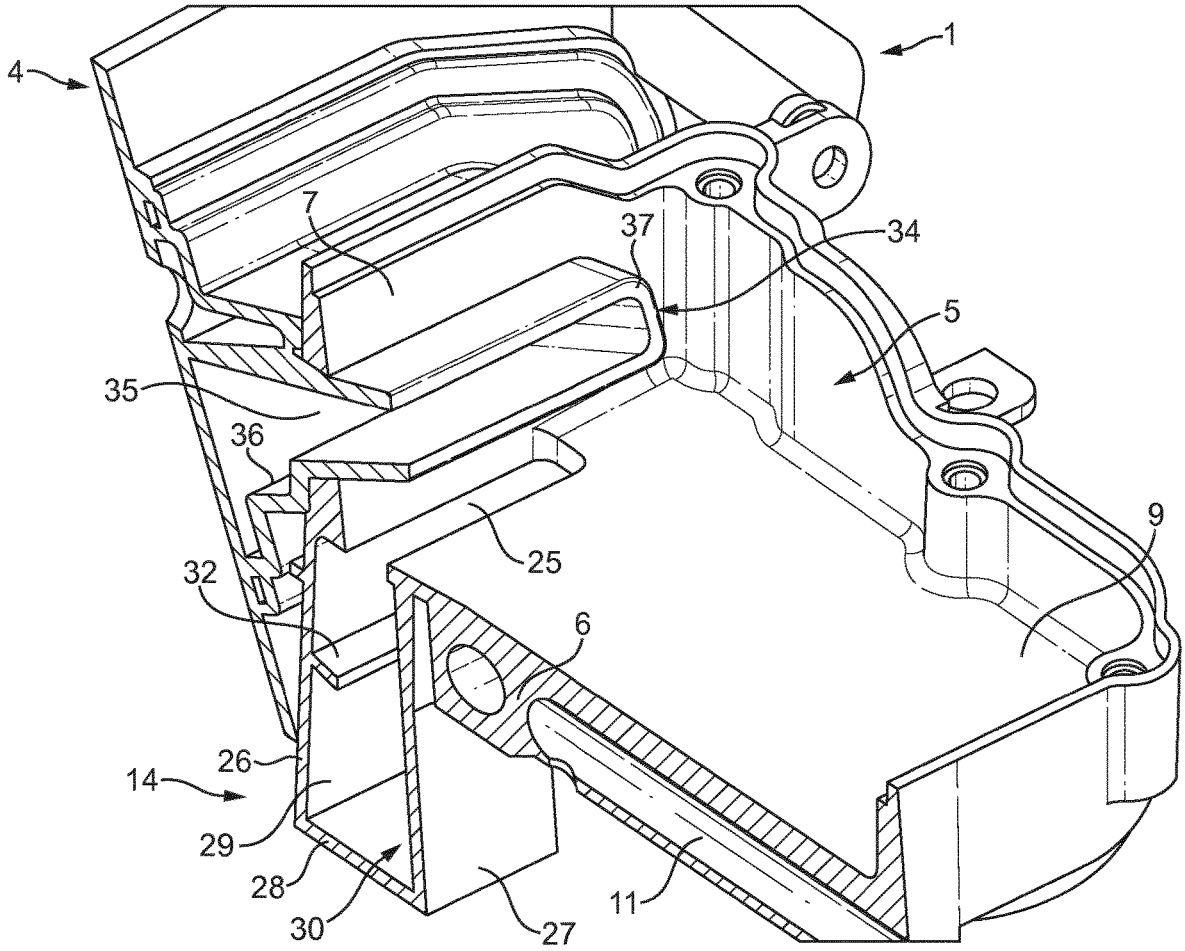
FIG. 3 shows a perspective view of the steam generating chamber of FIG. 2 which has been sectioned longitudinally to show the scale collection chamber of FIG. 1.

Referring now to FIG. 3, a perspective view of the steam generating chamber 5 which has been sectioned longitudinally to show the scale collection chamber 14 is shown. In the present embodiment, the scale collection chamber 14 comprises a front wall 26 which is proximate to the treatment surface 4 and a rear wall 27. The scale collection chamber 14 further comprises two side walls, one of which is visible in FIG. 1. Optionally, the front 26 and rear 27 walls extend away from the opening 25 in the bottom wall 6 of the steam generating chamber 5 to an end wall 28 of the scale collection chamber 14 which extends substantially parallel to the surface 9.

At least one of the front 26 and rear 27 walls form an angle of less than 90 degrees with the surface 9 of the steam generating chamber 5. In the present embodiment, both the front wall 26 and the rear wall 27 form an angle of less than 90 degrees with the surface 9, in opposite directions, such that the front 26 and rear 27 walls diverge as the distance from the opening 25 increases. The front wall 26 extends towards the treatment surface 4. The rear wall 27 extends parallel to or away from the treatment surface 4. As the distance from the opening 25 increases so does the cross-section of the scale collection chamber 14. Therefore, the volume of the scale collection chamber 14 is increased compared with an embodiment in which the front and rear walls 26, 27 extend perpendicularly from the opening 25, which means more scale can be collected before the scale collection chamber 14 is full. Preferably, the front 26 and rear 27 walls extend away from the opening 25 by at least about 5 mm, preferably by a distance of between about 10 mm to about 50 mm. In one embodiment, the front 26 and rear 27 walls may be different lengths or extend at different opposing angles and the end wall 28 may extend at an angle to the surface 9.

Furthermore, when the front wall 26 is inclined so that it forms an angle of less than 90 degrees relative to the surface 9 and diverges from the rear wall 27, it is inclined closer to the vertical than a perpendicular front wall 26 or inclined beyond the vertical so that its inner surface 29 forms an overhanging surface when the hand-held garment steamer 1 is in the second orientation B. Therefore, there is less chance of scale, or any unevaporated water, travelling along the inner surface of the front wall 26 and out of the scale collection chamber 14 because for a given volume of scale the hand-held garment steamer 1 would have to be tilted by a larger angle. A larger volume of the scale collection chamber 14 must be filled when the front wall 26 is inclined as shown in FIG. 3 before scale can exit the scale collection chamber 14 after entering, compared to a front wall 26 which is perpendicular to the surface 9 when the hand-held garment steamer 1 is in the second orientation B.

When the rear wall 27 is inclined so that it forms an angle of less than 90 degrees relative to the surface 9 and diverges from the front wall 26, it may be inclined closer to the vertical than a perpendicular rear wall 27 or inclined beyond the vertical so that its inner surface 30 forms an overhanging surface when the hand-held garment steamer 1 is in the first orientation A. Therefore, there is less chance of scale, or any unevaporated water, travelling along the inner surface of the rear wall 27 and out of the scale collection chamber 14 because for a given volume of scale the hand-held garment steamer 1 would have to be tilted by a larger angle. A larger volume of the scale collection chamber 14 must be filled when the rear wall 27 is inclined as shown in FIG. 3 before scale can exit the scale collection chamber 14 after entering, compared to a rear wall 27 which is perpendicular to the surface 9 when the hand-held garment steamer 1 is in the first orientation A.

Alternatively, the front 26 and rear 27 walls may extend perpendicularly downwards away from the opening 25 by a distance of at least about 5 mm, preferably between about 10 mm to about 50 mm, to create a sufficiently deep scale collection chamber 14 that helps to prevent scale exiting the scale collection chamber 14 once it has entered. As in this alternative embodiment the front 26 and rear walls 27 are perpendicular to the surface 9, the depth creates the larger volume which means more scale must build-up before it can exit the scale collection chamber 14. In another alternative embodiment, the scale collection chamber 14 may comprise an entrance section (not shown) which extends perpendicularly from the surface 9 and has a main body (not shown) which extends generally parallel to and below the surface 9.

In one embodiment, the scale collection chamber 14 may further comprise a barrier element 32 which is configured to prevent scale, and any unevaporated water, collected in the scale collection chamber 14 from escaping the scale collection chamber 14. As shown in FIG. 3, the barrier element 32 is a wall which protrudes from the inner surface 29 of the front wall 26 into the scale collection chamber 14. Preferably, the barrier element 32 covers between about 20% to about 70% of the opening 25. The barrier element 32 extends along the width of the front wall 26 of the scale collection chamber 14 from one side wall, seen in FIG. 1, to the other proximate to the opening 25 in the surface 9 which allows the scale collection chamber 14 to maximize the amount of scale it can prevent from escaping the scale collection chamber 14.

The barrier element 32 is configured to allow scale to enter the scale collection chamber 14 but to prevent scale from exiting the scale collection chamber 14 when the hand-held garment steamer 1 is in the second orientation B once the scale has passed the barrier element 32. Therefore, as shown in FIG. 3, the barrier element 32 protrudes from the front wall 26 at an angle to the surface 9 and towards the end wall 28 of the scale collection chamber 14. In an alternative embodiment, the rear wall 27 may comprise a barrier element 32 to prevent scale exiting the scale collection chamber 14 when the hand-held garment steamer is in the first orientation A. In another embodiment, both the front 26 and rear 27 walls may comprise barrier elements 32.

The scale collection chamber 14 may be removable from the steam generating chamber 5. This allows a user to empty the scale collection chamber 14 when it is full instead of replacing the entire hand-held garment steamer 1. The scale collection chamber 14 may be connected to a section of the housing 2, shown in FIG. 1, which has, for example, but not limited to, a release button (not shown) so that the scale collection chamber 14 may be removed. The scale collection chamber 14 may be removed, cleaned, and reinstalled or alternatively may be replaced by a new scale collection chamber 14.

Furthermore, in an alternative embodiment, the end wall 28 of the scale collection chamber 14 may be removable from the front 26, rear 27, and side walls of the scale collection chamber 14 which can then be emptied and/or cleaned by a user.

The scale collection chamber 14 is not heated directly. However, it may also be heated due to its proximity to the heater 10 embedded in the bottom wall 6 of the steam generating chamber 5. The scale collection chamber 14 may be thermally isolated from the surface 9 by, for example, forming the scale collection chamber 14 from a material which is not thermally conductive or less thermally conductive than the surface 9 to reduce the temperature of the scale collection chamber 14. In yet another embodiment, the scale collection chamber 14 may be formed from the same material as the surface 9. Such an embodiment may comprise a thermal restriction section (not shown) placed between and joining the surface 9 and the scale collection chamber 14, which limits the heat flowing from the surface 9 to the scale collection chamber 14. Although all or substantially all of the water is evaporated on the surface 9 without entering the scale collection chamber 14, any water that does enter the scale collection chamber 14 will not evaporate as the temperature of the scale collection chamber 14 will not be sufficiently high enough.

Referring now to both FIG. 2 and FIG. 3, the hand-held garment steamer 1 further comprises a steam channel 34 and a steam vent 34A. The steam channel 34 connects the steam vent 34A on the treatment surface 4 with the steam generating chamber 5. The steam vent 34A is configured to eject steam generated in the steam generating chamber 5 towards a garment being steamed. The steam vent 34 extends through the side wall 7 of the steam generating chamber 5 through to the treatment surface 4.

The steam channel 34 comprises an aperture 35 for the passage of steam out of the steam generating chamber 5. In the present embodiment, the aperture 35 is generally rectangular, but is not limited thereto. The aperture 35 extends further across the width of the side wall 7 proximate to the treatment surface 4 than the opening 25 extends across the width of the surface 9. As can be seen in FIG. 3, the aperture 35 extends from the steam generating chamber 5 to the treatment surface 4. The cross-sectional area of the aperture 35 increases as it approaches the treatment surface 4 so that steam is delivered over a wider area.

Figure 5:
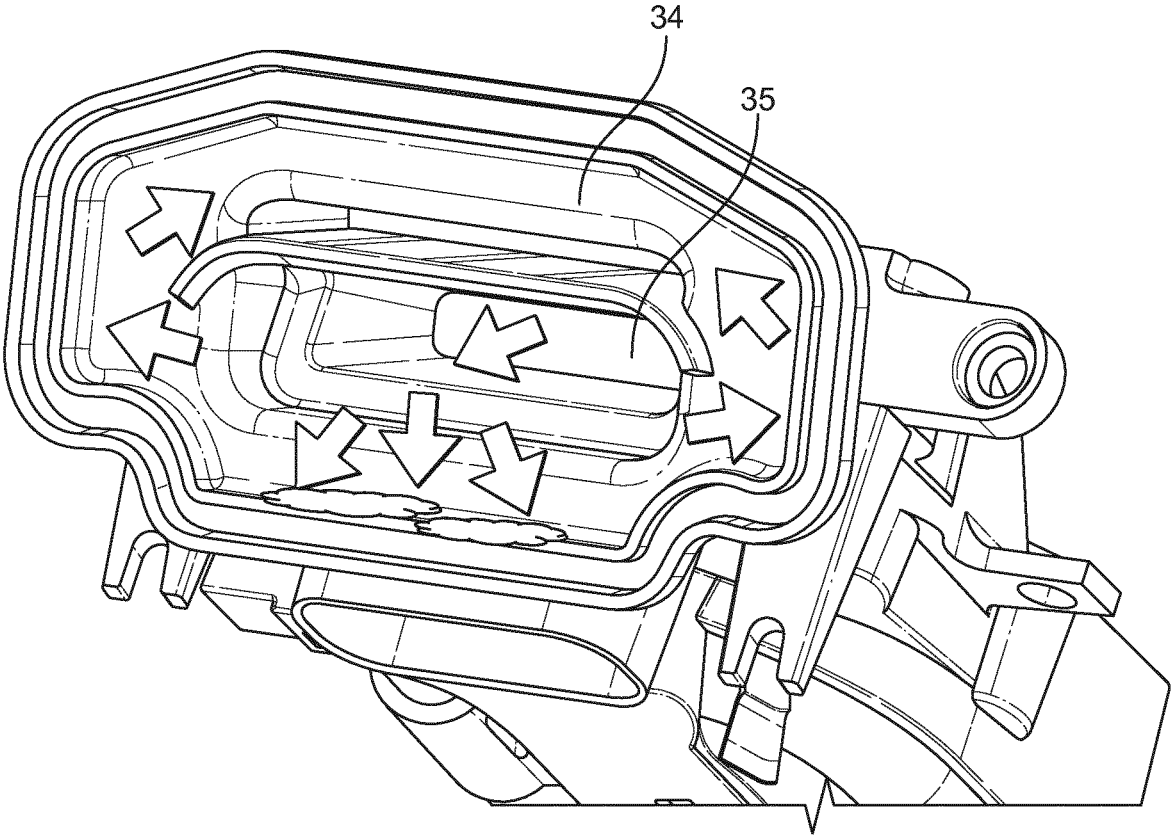
FIG. 5 shows a front perspective view of the steam generating chamber of FIG. 1 to FIG. 4 with a treatment surface of the hand-held garment steamer removed.
Figure 6:
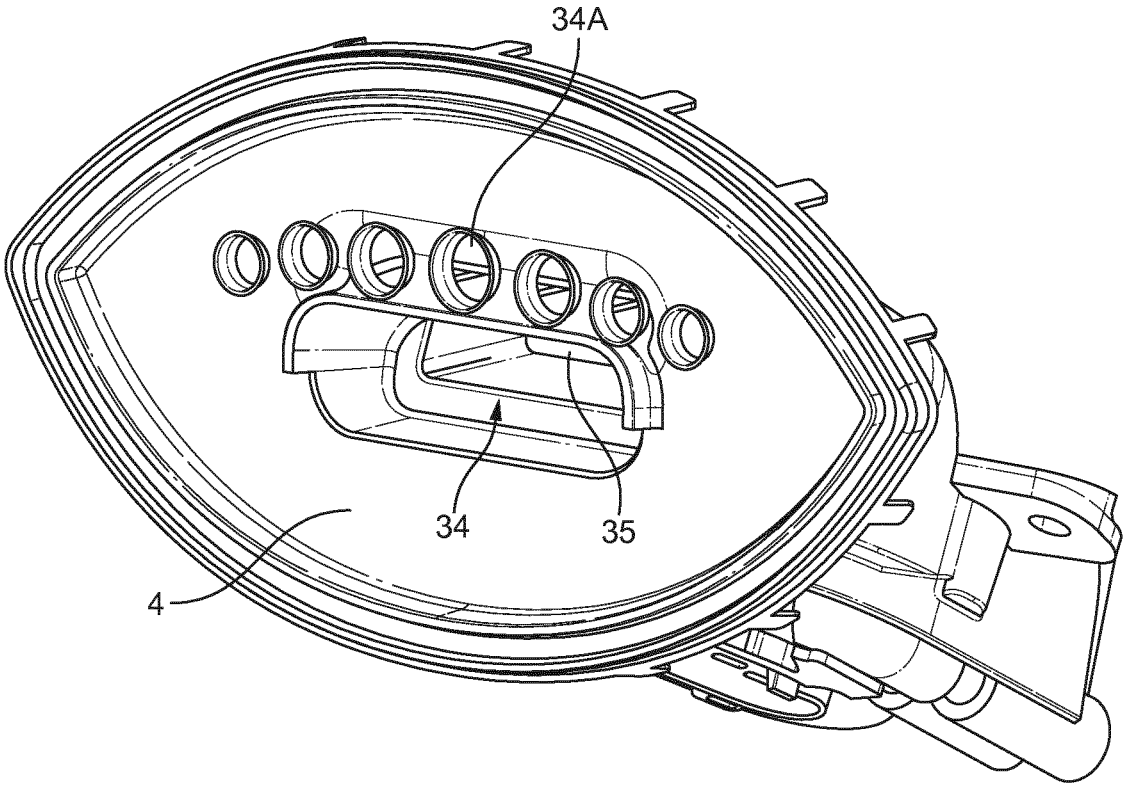
FIG. 6 shows the front perspective view of the steam generating chamber of FIG. 5 with the treatment surface of the hand-held garment steamer in place.

In an alternative embodiment, as shown in FIG. 6, the treatment surface 4 may contain steam vents 34A which the steam channel 34 communicates with instead of the steam being ejected straight through steam channel 34, as shown in FIG. 3. For better illustration to the skilled person, the treatment surface 4 in FIG. 6 is made transparent to show interior of the garment steamer appliance. The steam channel 34 may be tortuous as illustrated in FIG. 5. Steam entering the aperture 35 travels along the tortuous steam channel 34. The tortuous path helps to trap water droplets carried by the steam. Furthermore, the walls forming the channel 34 may be heated by heater 10. There may be an intermediate section coupling the heater 10 and the walls of the steam channel. The intermediate section may be configured to transmit heat from the heater 10 to the walls of the steam channel 34. Alternatively, the hand-held garment steamer 1 may comprise a separate heater (not shown) for heating the walls of the steam channel 34. This reduces the likelihood of water condensing along the steam channel 34. Furthermore, heating the steam channel 34 evaporates the water that has condensed. This also helps to ensure to reduce the water droplets present in the steam that is emitted from the steam vent 34A. As can be seen in FIG. 2 and FIG. 3, the steam channel 34 is located above the opening 25 to the scale collection chamber 14 in the side wall 7 of the steam generating chamber 5 proximate to the treatment surface 4 in the first A and second B orientations such that a portion of the side wall 7 exists between the opening 25 and the steam channel 34.

In the present embodiment, the steam channel 34 protrudes into the steam generating chamber 5 over the opening 25 to the scale collection chamber 14. The steam channel 34 terminates in an end face 37 in which the aperture 35 is provided. The steam vent 34 may extend into the steam generating chamber 5 beyond the opening 25 to the scale collection chamber 14. The steam channel 34 may extend or protrude at least about 2 mm, preferably at least about 5 mm into the steam generating chamber 5. The walls of the steam channel 34 may have a tapered end. In one embodiment, the portion of the steam channel 34 extending into the steam generating chamber 5 may not be fully enclosed by the wall. In other words, the walls defining the portion of the steam channel 34 extending into the steam generating chamber 5 may at least partially surrounding the aperture 35. The steam channel 34 extends substantially perpendicularly to the treatment surface 4 such that it enters the steam generating chamber 5 through the side wall 7 at an angle relative to the surface 9. In an alternative embodiment, the steam vent 34 may extend parallel to the surface 9 and eject steam at an angle to the horizontal when the hand-held garment steamer 1 is in the first orientation A.

This helps to prevent scale or water travelling along front wall 26 of the scale collection chamber 14, shown in FIG. 3, or the surface 9 when the hand-held garment steamer 1 is in the second orientation B and up the side wall 7 straight into the steam channel 34. Instead, the steam channel 34 extending into the steam generating chamber 5 beyond the side wall 7 prevents the scale or water from escaping through the aperture 35. Therefore, stains and wet spots on the garment being treated are avoided.

The protrusion of the steam channel 34 and the heated tortuous path to the steam vent 34A may allow the hand-held garment steamer 1 to be suitable to be used for horizontal steaming. In horizontal steaming, the treatment surface 4 faces downwards with the steam generation chamber 5 above the treatment surface 4, which increases the likelihood of water getting into the steam channel 34 and escaping from steam vent 34A. The protrusion of the steam channel 34 into the steam generating chamber 5 reduces the likelihood of liquid water from escaping from the steam generating chamber 5 to the steam vent 34A. The heating of tortuous steam channel 34 helps to evaporate any water that has got into the steam channel 34. Hence, chances of water escaping from the steam vent 34A and staining the garment may be reduced.

In FIGS. 1-3 and 7-8, the scale collection chamber 14 and the opening 25 are positioned at an end of the steam generating chamber 5 proximate to the treatment surface 4. In the embodiments shown in FIGS. 1-3 and 7-8, the steam vent 34 may be configured so that steam is ejected therefrom towards a garment when the garment steamer is being held in said first orientation.

Figure 9:
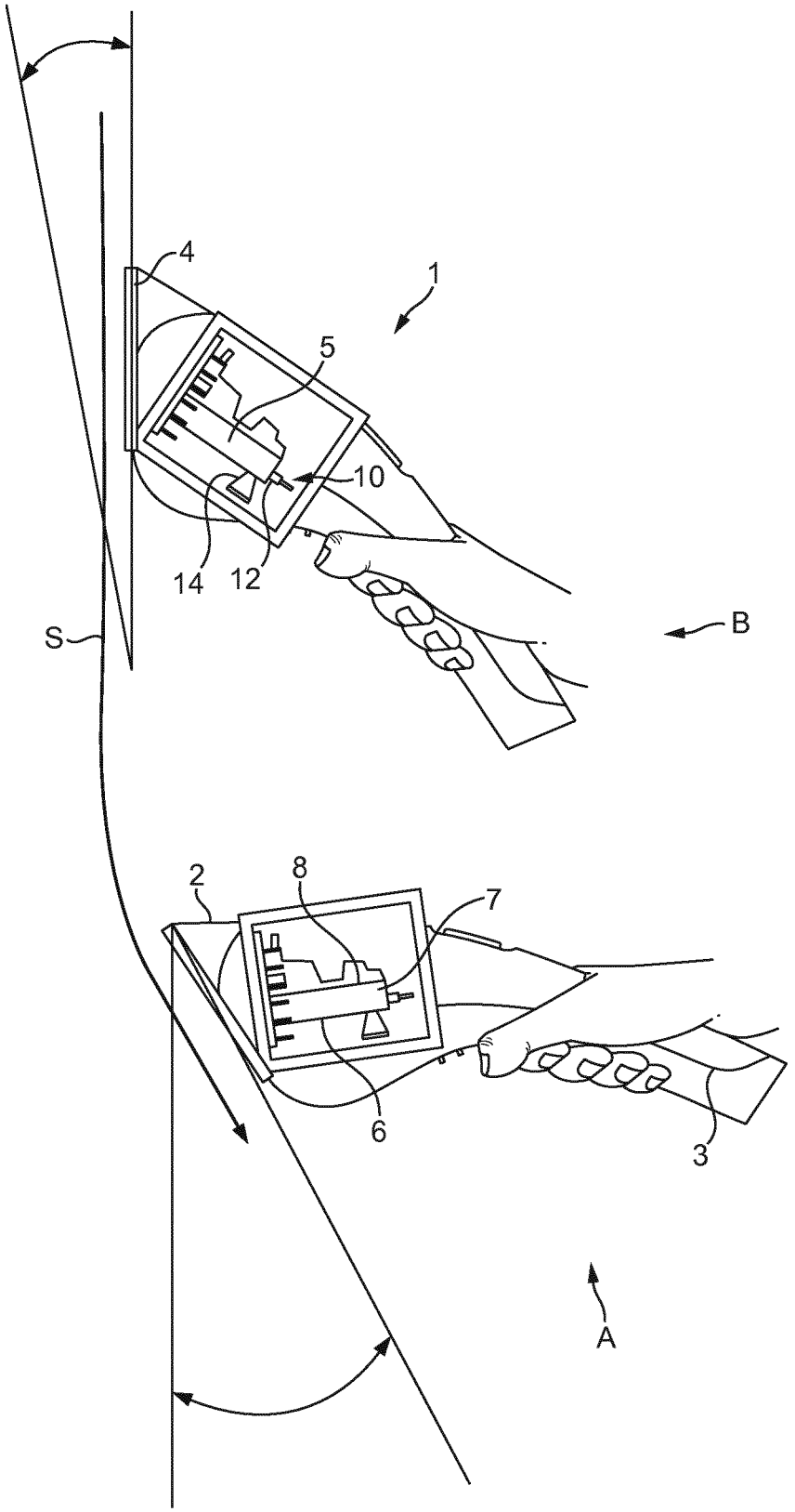
FIG. 9 shows a side view of a first and second orientation of the hand-held garment steamer with a section of the housing portion removed to show a third embodiment of the steam generating chamber and the scale collection chamber.

In an alternative embodiment, such as that shown in FIG. 9, the steam vent 34 (not shown in FIG. 9) is configured to eject steam towards a garment when the hand-held garment steamer 1 is in the second orientation B. To achieve this, the scale collection chamber 14 and the opening 25 are positioned at an end of the steam generating chamber 5 distal to the treatment surface 4, as shown in FIG. 9.

Similarly to the embodiment shown in FIG. 1, when the garment steamer 1 is held in a first orientation A in which the surface 9 extends downwardly away from the opening 25, water fed onto the surface 9 flows away from the opening 25 to be evaporated from the surface 9, and when the garment steamer 1 is tilted into a second orientation B in which the surface 9 extends downwardly towards the opening 25, scale dislodged from the surface 9 falls into the scale collection chamber 14 through the opening 25. The difference between the embodiments shown in FIG. 1 and FIG. 9 is that in FIG. 9, the hand-held garment steamer is at the top of the steaming stroke S when it is held in its second orientation B.

Figure 10:
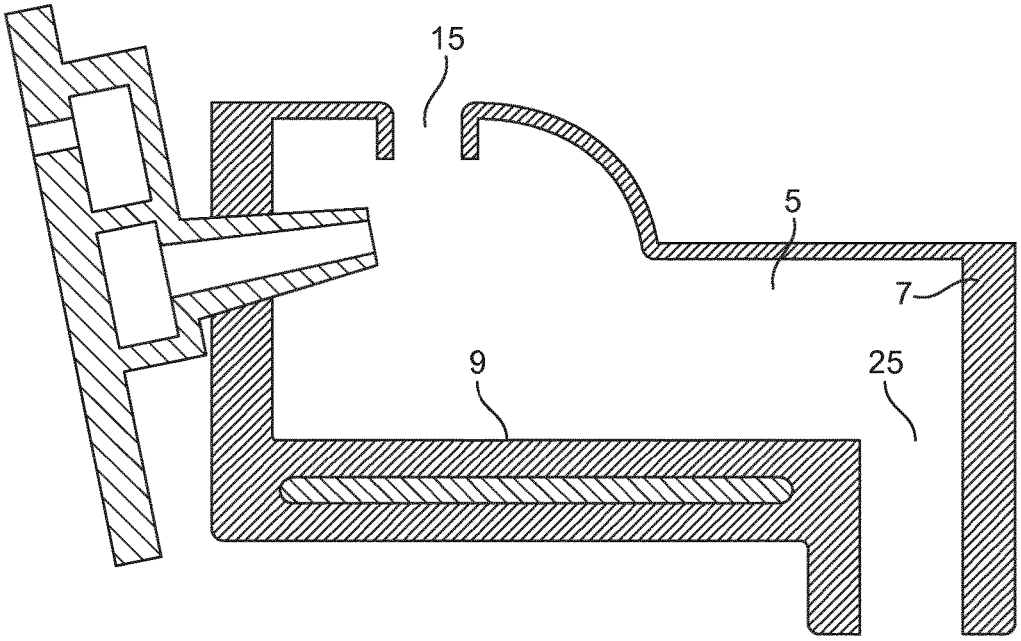
FIG. 10 shows a schematic cross-sectional side view of the embodiment of the steam generation chamber and scale collection chamber shown in FIG. 9.
Figure 11:
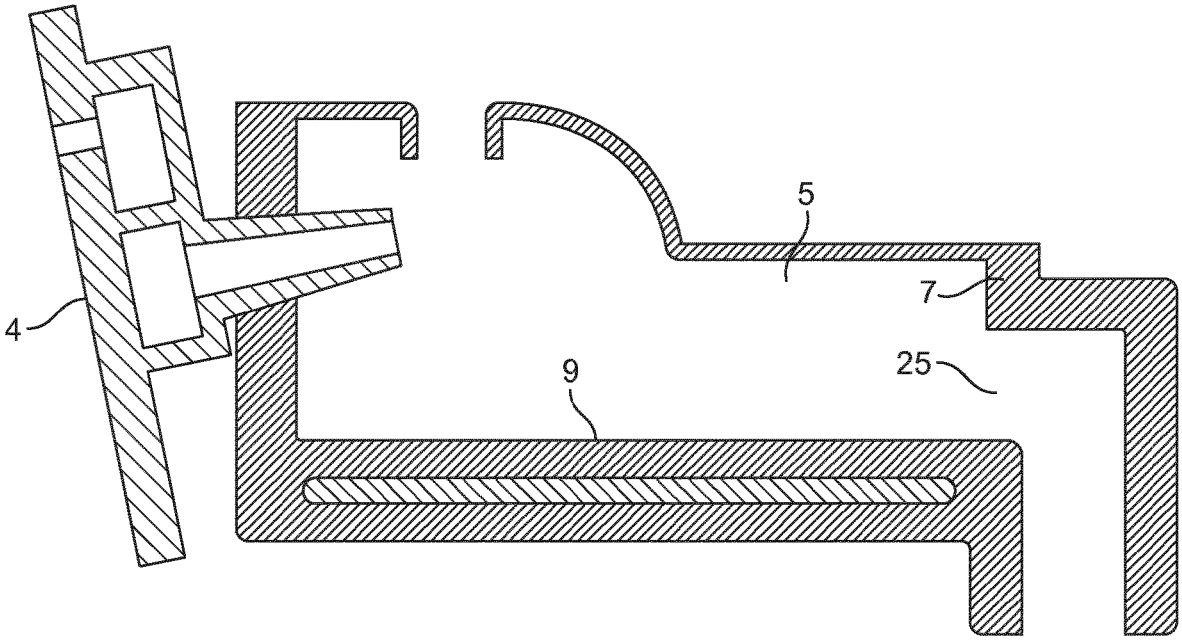
FIG. 11 shows a schematic cross-sectional side view of a fourth embodiment of the steam generation chamber and scale collection chamber.

FIG. 10 shows the embodiment shown in FIG. 9 in which the opening 25 is in the surface 9 at the distal end of steam generating chamber 5. Furthermore, the opening 25 is at the opposite end of the surface 9 to the water inlet 15. FIG. 11 shows another embodiment in which the opening 25 is in side wall 7 of the steam generating chamber 5, i.e. on the portion of the side wall 7 that is distal to the treatment surface 4. In yet another embodiment, the steam vent 34 may be configured to eject steam towards a garment when the hand-held garment steamer 1 is in the first orientation and the second orientation.

Figure 12:
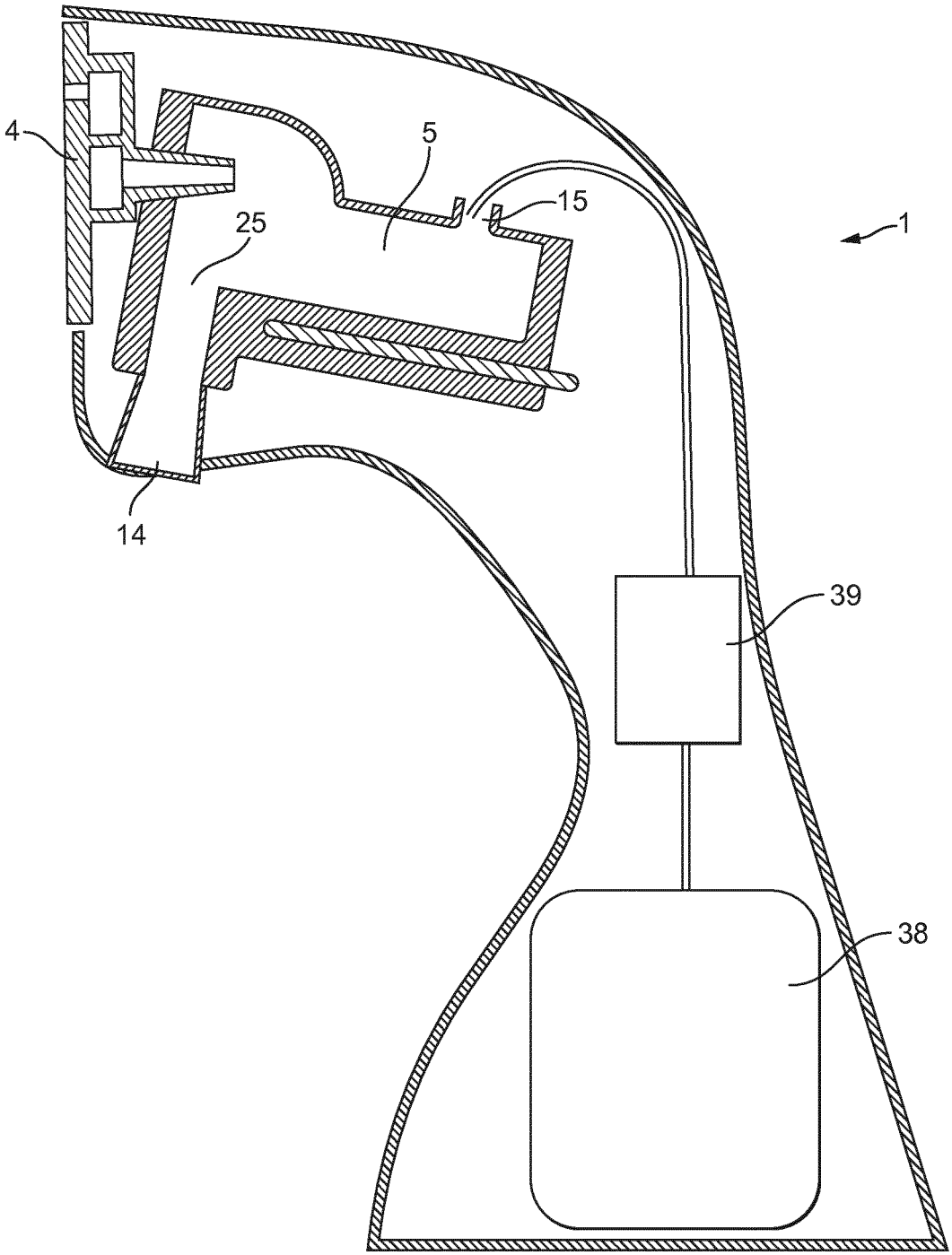
FIG. 12 shows a schematic cross-sectional side view of a hand-held garment steamer with an in-built water reservoir.

The hand-held garment steamer 1 may comprise a water reservoir 38 as shown in FIG. 12. The water reservoir 38 may be detachable. The hand-held garment steamer 1 may further comprise a pump 39 to direct water from the water reservoir 38 to the water inlet 15.

Figure 4:
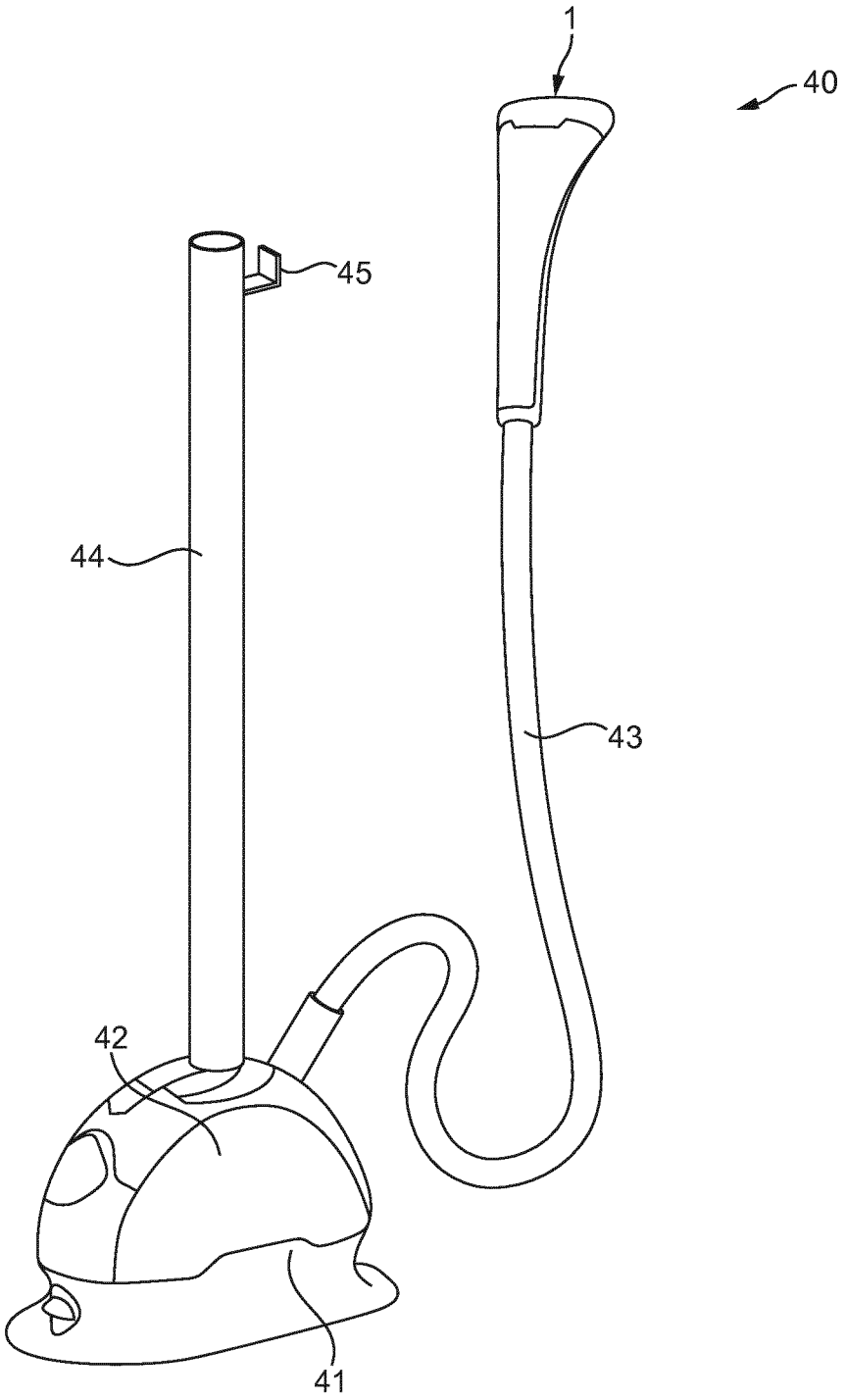
FIG. 4 shows a garment steaming system comprising the hand-held garment steamer of FIG. 1 to FIG. 3.

Referring now to FIG. 4, a garment steaming system 40 is shown comprising the hand-held garment steamer 1 described above. The garment steaming system 40 further comprises a base unit 41 having a reservoir 42 for storing and supplying water to the hand-held garment steamer 1 for conversion into steam. The base unit 41 is connected to the hand-held garment steamer 1 by a hose 43. The hose 43 is flexible and encloses at least a tube (not shown) for supplying water from the reservoir 42 to the water inlet 15, shown in FIG. 1. The hose 43 may also carry power cables (not shown) to provide the heater 10 with electricity. The garment steaming system 40 further comprises a stand 44 on which to hang a garment to be steamed. The stand 44 extends perpendicularly from the base unit 41. The stand 44 comprises a hanging element 45 such as, for example, a hook.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A hand-held garment steamer comprising:

a treatment surface configured for placement proximate to a fabric to be treated and positioned to be substantially vertical in a first orientation and rotatable through an angle of up to 90 degrees to a second orientation in which the treatment surface is positioned at an angle to the vertical, a steam generating chamber including a top wall, a bottom wall, and a sidewall, wherein longer sides of a top surface of the bottom wall extend away from the treatment surface, and wherein lower sides of the top surface of the bottom wall extend from the sidewall away from the treatment surface, a heater comprising a heating element embedded in a bottom wall of the steam generating chamber, the heater configured to heat a top surface of the bottom wall of the steam generating chamber such that water fed onto the surface is converted into steam, a steam channel comprising an aperture for the passage of steam out of the steam generating chamber, the steam channel connecting a steam vent on the treatment surface with the steam generating chamber, the steam vent extending through a side wall of the steam generating chamber through to the treatment surface, a scale collection chamber positioned below the steam generating chamber and comprising a front wall proximate the treatment surface a rear wall, and two side walls, the scale collection chamber further comprising an opening, wherein the top surface of the bottom wall of the steam generating chamber and the opening are positioned relative to each other and configured such that:

a) when the garment steamer is in the first orientation in which the top surface of the bottom wall extends downwardly away from the opening, water fed onto the surface flows away from the opening to be evaporated from the surface, and b) when the garment steamer is in the second orientation in which the top surface of the bottom wall extends downwardly towards the opening, scale dislodged from the surface falls into the scale collection chamber through the opening, wherein said scale collection chamber is located below the steam generating chamber in both the first orientation and the second orientation.

2. The hand-held steamer according to claim 1, wherein the treatment surface of the hand-held steamer is at any angle between about 45 to 165 degrees from the surface to be treated.

3. The hand-held garment steamer according to claim 2, wherein the aperture is spaced above the opening to the scale collection chamber in the first orientation and in the second orientation (B).

4. The hand-held garment steamer according to claim 3, wherein the steam channel protrudes into the steam generating chamber over the opening to the scale collection chamber, the steam channel terminating in an end face in which the aperture is provided.

5. The hand-held steamer according to claim 1, wherein the steam vent is configured to eject steam towards a garment.

6. The hand-held steamer according to claim 5, wherein the steam channel is tortuous.

7. The hand-held steamer according to claim 5, further comprising an intermediate section coupling the heater and walls of the steam channel, said intermediate section being configured to transmit heat from the heater to the walls of the steam channel.

8. The hand-held garment steamer according to claim 1, wherein the scale collection chamber is located at one end of the surface.

9. The hand-held garment steamer according to claim 1, wherein the scale collection chamber is configured to trap scale collected in the scale collection chamber to prevent it from escaping the scale collection chamber as the garment steamer is tilted between the first orientation (A) and the second orientation (B).

10. The hand-held garment steamer according to claim 9, wherein the scale collection chamber comprises a barrier element to prevent scale collected in the scale collection chamber from escaping the scale collection chamber.

11. The hand-held garment steamer according to claim 1, wherein the scale collection chamber is removable.

12. The hand-held garment steamer according to claim 1, comprising a water inlet to feed water onto the surface.

13. The hand-held garment steamer according to claim 12, comprising an in-built water reservoir.

14. The hand-held garment steamer according to claim 13, comprises a pump to direct water from the water reservoir to the water inlet.

15. A garment steaming system comprising:

the hand-held garment steamer according to claim 1;

a stand on which to hang a garment to be steamed; and a water reservoir for supplying water to the hand-held garment steamer for conversion into steam.

16. The hand-held garment steamer according to claim 1, wherein the steam generating chamber extends at an angle to the treatment surface to allow rotation through a horizontal plane as the hand-held garment steamer is moved along a stream stroke from a first orientation to a second orientation.

17. The hand-held garment steamer according to claim 1, wherein the aperture of the steam channel extends further across a width of the side wall of the steam generating chamber proximate the treatment surface than the opening in the bottom wall of the scale collection chamber extending across the width of the surface.

18. The hand-held garment steamer according to claim 1, wherein the front and rear walls of the steam collection chamber extend substantially parallel to the top surface of the bottom wall.

19. The hand-held garment steamer according to claim 1, wherein the front and rear walls of the steam collection chamber extend away from the opening in the bottom wall of the steam generating chamber.

* * * * *